US009803936B2

(12) United States Patent
Mun

(10) Patent No.: US 9,803,936 B2
(45) Date of Patent: Oct. 31, 2017

(54) TUBULAR HEAT EXCHANGER

(71) Applicant: Cheon Su Bak, Incheon (KR)

(72) Inventor: Eun Guk Mun, Gimpo-si (KR)

(73) Assignee: Cheon Su Bak, Incheon (KR)

( * ) Notice: Subject to any disclaimer, the term of this patent is extended or adjusted under 35 U.S.C. 154(b) by 199 days.

(21) Appl. No.: 14/412,529

(22) PCT Filed: Jun. 21, 2013

(86) PCT No.: PCT/KR2013/005492
§ 371 (c)(1),
(2) Date: Jan. 2, 2015

(87) PCT Pub. No.: WO2014/007478
PCT Pub. Date: Jan. 9, 2014

(65) Prior Publication Data

US 2015/0192372 A1 Jul. 9, 2015

(30) Foreign Application Priority Data

Jul. 5, 2012 (KR) ..... 10-2012-0073335
Dec. 5, 2012 (KR) ..... 10-2012-0140455

(51) Int. Cl.
*F28F 9/02* (2006.01)
*F28F 1/40* (2006.01)
(Continued)

(52) U.S. Cl.
CPC ..... *F28F 1/40* (2013.01); *F28F 1/022* (2013.01); *F28F 1/128* (2013.01); *F28F 19/00* (2013.01);
(Continued)

(58) Field of Classification Search
CPC .... F28F 1/40; F28F 19/00; F28F 1/128; F28F 1/022
See application file for complete search history.

(56) References Cited

U.S. PATENT DOCUMENTS 5,251,692 A * 10/1993 Haussmann ..... F28D 1/05383 165/152
7,059,399 B2 * 6/2006 Chin ..... F28D 1/05391 165/146
(Continued)

FOREIGN PATENT DOCUMENTS

JP 2002-139282 A 5/2002
JP 2002139282 A * 5/2002
(Continued)

*Primary Examiner* — Grant Moubry
*Assistant Examiner* — Jon T Schermerhorn
(74) *Attorney, Agent, or Firm* — IM IP Law; C Andrew Im

(57) ABSTRACT

A tubular heat exchanger includes tubes, each having a plurality of cells inside, stacked in multiple stages and zigzag-bent heat-radiating fins brazed and integrated among the tubes. The gaps among the tubes become progressively wider toward the rear to enable foreign substance to be discharged without being caught by the heat-radiating fins. The upper and lower surfaces are formed of an inclined surface progressively and symmetrically reduced and inclined rearwardly with respect to a tube center line to have the front cell thicker than the end cell. The upper and lower surfaces of the heat-radiating fins are formed of an inclined surface progressively and symmetrically enlarged and inclined rearwardly with respect to a fin center line. A wind direction guiding ribs, tilted toward the upper and lower surfaces of the tubes, protrude from the heat-radiating fins to blow the wind along the upper and lower surfaces of the tubes.

3 Claims, 4 Drawing Sheets

(51) Int. Cl.
*F28F 19/00* (2006.01)
*F28F 1/02* (2006.01)
*F28F 1/12* (2006.01)

(52) U.S. Cl.
CPC ..... *F28F 2215/00* (2013.01); *F28F 2250/02* (2013.01)

(56) References Cited

U.S. PATENT DOCUMENTS

| | | | | |
|---|---|---|---|---|
| 8,938,988 | B2 * | 1/2015 | Yanik | F25B 39/00 62/515 |
| 2002/0066554 | A1 * | 6/2002 | Oh | F28D 1/0535 165/179 |
| 2012/0267086 | A1 * | 10/2012 | Yanik | F25B 39/00 165/174 |

FOREIGN PATENT DOCUMENTS

| | | | |
|---|---|---|---|
| JP | 2004-271113 | A | 9/2004 |
| JP | 2008-241057 | A | 10/2008 |
| JP | 2008241057 | A * | 10/2008 |
| KR | 10-0518856 | B1 | 9/2005 |

* cited by examiner

[Fig. 1]
(PRIOR ART)
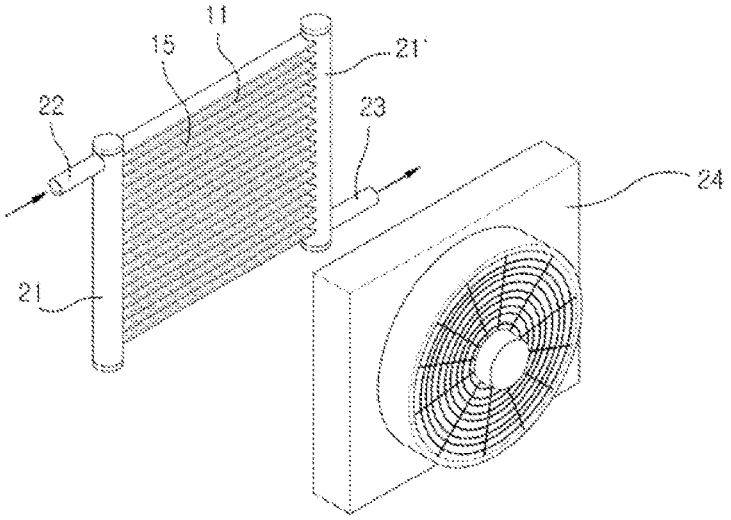
[Fig. 2]
(PRIOR ART)
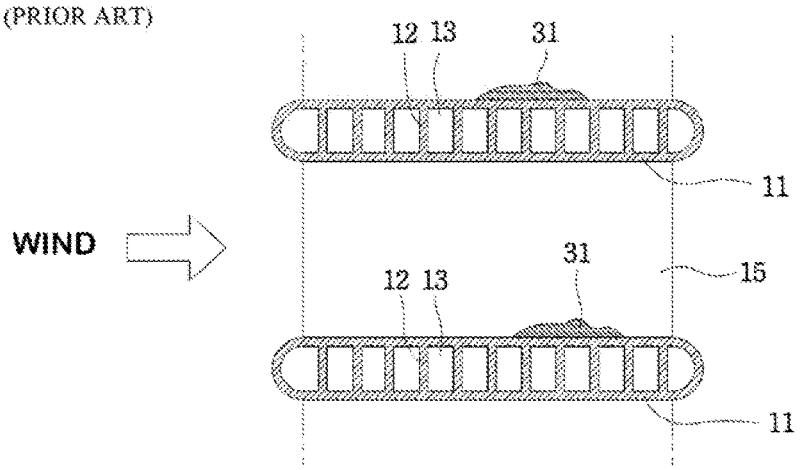
[Fig. 3]
(PRIOR ART)
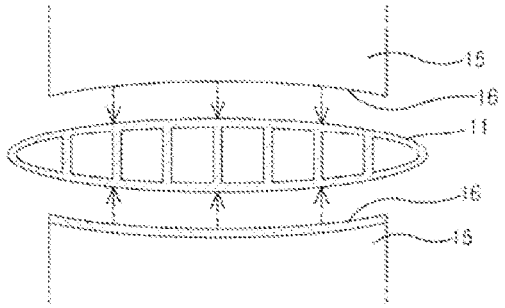

[Fig. 4]
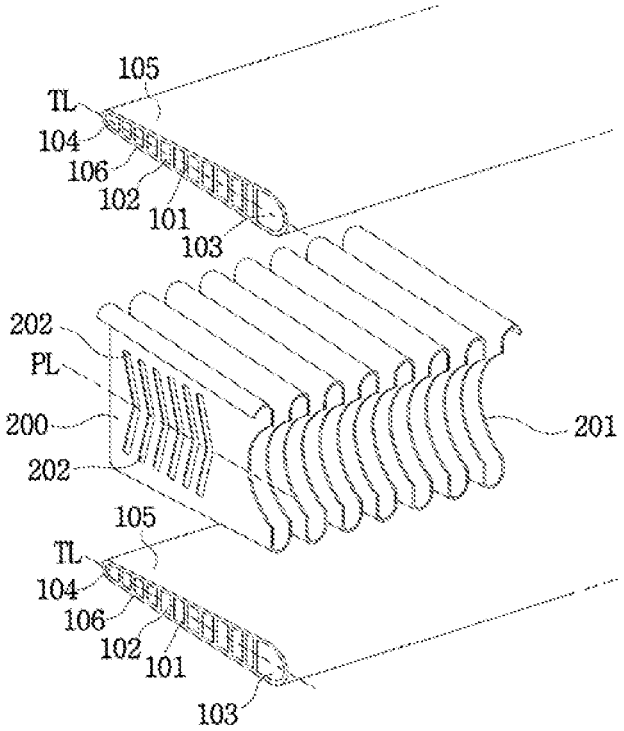
[Fig. 5]
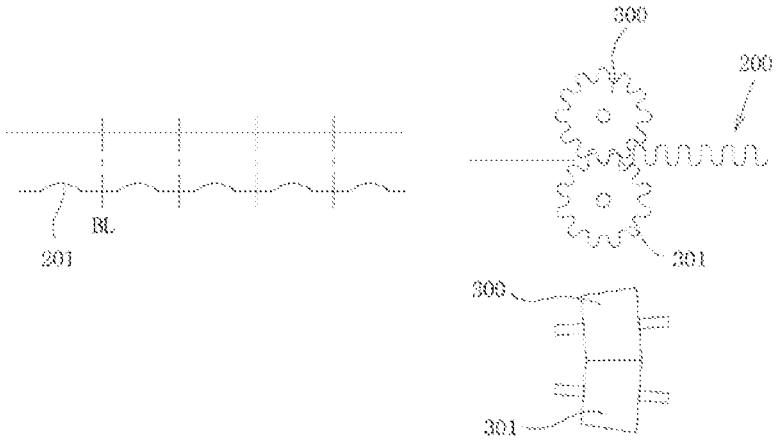

[Fig. 6]
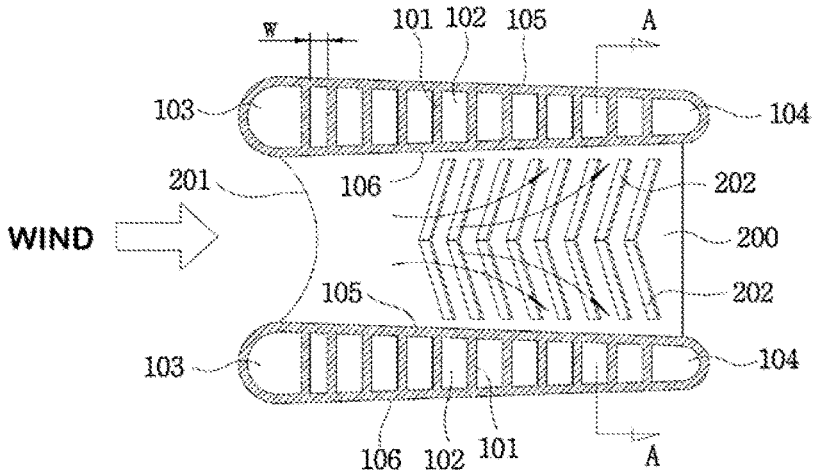
[Fig. 7]
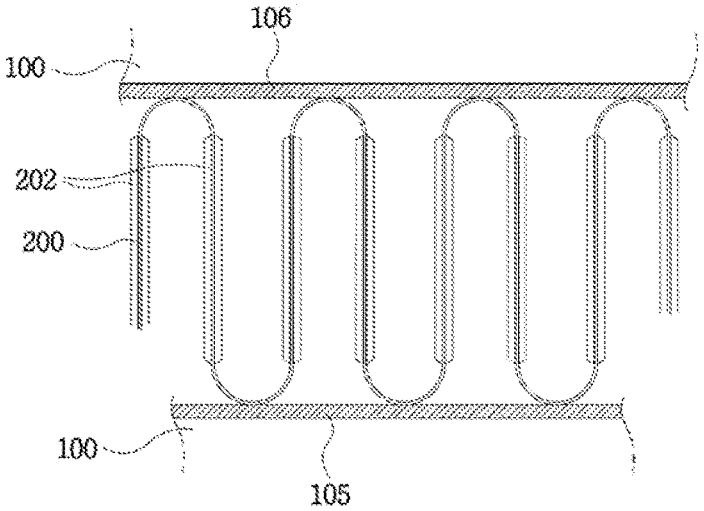
[Fig. 8]
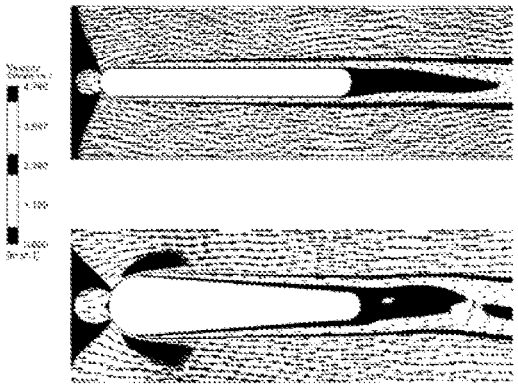

[Fig. 9]
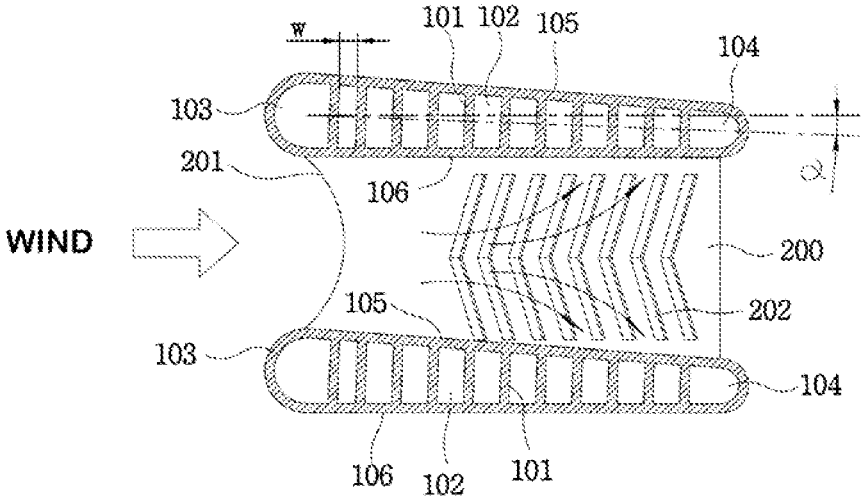

TUBULAR HEAT EXCHANGER

BACKGROUND OF THE INVENTION

Field of the Invention

The present invention relates to a tubular heat exchanger, and more particularly, to a tubular heat exchanger which includes tubes, each having a plurality of cells inside, stacked in multiple stages and zigzag-bent heat-radiating fins brazed and integrated among the tubes, wherein gaps among the tubes become progressively wider toward the rear to enable foreign substance to immediately be discharged without being caught by the heat-radiating fins, and an air-cooling performance at a tube surface is not degraded even if the rear gaps among the tubes become wider.

Background of the Related Art

An air-cooled type tubular heat exchanger, used in a radiator or an air conditioner of a vehicle, is an apparatus which conducts heat toward air in a process, wherein high-temperature fluid is moved, in order to lower the temperature of fluid or refrigerant.

FIG. 1 is a conventional tubular heat exchanger having tubes 11, through which fluid is moved, connected in multiple stages between a header pipe 21 and the other header pipe 21', and corrugated heat-radiating fins 15 of thin metallic material for heat radiation attached among the tubes 11 with a brazing method, wherein high-temperature fluid supplied to the header pipe 21 through a supply duct 22 is distributed through the tubes 11 to be discharged to a discharge duct 23 through the other header pipe 21', and air blown by operation of a blower fan 24 passes among the corrugated heat-radiating fins 15 attached among the tubes 11 at the same time. Here, the hot air of the high-temperature fluid is cooled by wind through the tubes 11 and the heat-radiating fins 15.

As in FIG. 2, a cross-section of the conventional tubes 11 disclosed in Kor. Pat. No. 518856 is a rectangular shape, wherein cells 13 divided by a plurality of partition walls 12 are formed inside, and the corrugated fins 15 of metallic material are attached on upper and lower surfaces of the tubes 11 to be used. However, the tubes 11 for a heat exchanger cause the following problems.

The upper and lower surfaces of the tubes 11 are horizontally formed, and the width of a front end and the width of a rear end are equal, causing foreign substance 31 to easily be accumulated and fixed, thereby lowering heat exchange efficiency due to the foreign substance 31. To prevent the foreign substance 31 from easily being accumulated in the tubes 11, the tubes 11 may be formed in an oval shape as in FIG. 3 to enable the foreign substance 31 to naturally be flowed downward. However, if the tubes 11 are formed in the oval shape, surfaces of the corrugated fins 15 coming in contact with surfaces of the tubes 11 also have to be formed in a curved line, thereby making the manufacturing process of the corrugated fins 15 complex and lowering productivity. Also, a central portion among the tubes is narrow, thereby causing a bottleneck phenomenon if foreign substance is stuck.

A technology, wherein a front end of a tube is narrower than a rear end of the tube to enable gaps among the tubes become narrower toward the rear, is suggested by Jap. Pat. No. 20-241057. This is to reduce airflow resistance. The gaps among the tubes become narrower from the front to the rear in order to initially reduce the airflow resistance when wind from a blower fan passes among the tubes, and to enable moisture to be dropped by tilting front portions of the tubes downward if the moisture is formed on the tube surfaces.

Although the airflow resistance is reduced, the rear gaps among the tubes become relatively narrower, thereby causing foreign substance to be accumulated in the rear gaps among the tubes if the heat exchanger is used as an outdoor unit in the Middle East where a sandstorm frequently occurs or in China where the yellow dust severely occurs.

Also, a technology, wherein a front end of a tube is thicker than a rear end of the tube to enable the foreign substance to naturally be discharged, is suggested by Jap. Pat. No. 14-139282.

However, the thick front end of the tube cause the front gaps among the tubes become relatively narrower than the rear gaps, thereby generating airflow resistance. The upper and lower surfaces of the tubes are formed in a streamlined shape, thereby causing a difficulty of manufacturing a groove of a cooling plate in the streamlined shape. Particularly, the cooling plate is formed by arranging a vertically-stood single plate, thereby occupying a relatively greater area than a cooling fin, shortened by being zigzag-bent, to enlarge a heat-radiating area, and being impossible to be used in a narrow installation space due to the cooling plate protruded toward the rear by being deviated from a rear portion of the tube.

SUMMARY OF THE INVENTION

Accordingly, the present invention has been made in view of the above-described problems, and an object of the present invention is to provide a tubular heat exchanger which includes tubes, each having a plurality of cells inside, stacked in multiple stages, and zigzag-bent heat-radiating fins brazed and integrated among the tubes, wherein gaps among the tubes become wider toward the rear to enable foreign substance to immediately be discharged without being caught by the heat-radiating fins, and an air-cooling performance at a tube surface is not degraded even if the rear gaps among the tubes become wider.

Another object of the present invention is to provide a tubular heat exchanger which cuts a portion of each of the heat-radiating fins placed in the front gaps to reduce wind pressure in order to prevent the airflow resistance from being increased even if the front gaps among the tubes become relatively narrower than the rear gaps, wherein a heat-radiating area is reduced as much as the cut portion, but the rear gaps among the tubes are relatively increased than the front gaps to enlarge the heat-radiating area as much as the reduced heat-radiating area, thereby complementing the reduced heat-radiating area.

To accomplish the above-mentioned objects, the tubular heat exchanger includes tubes, each having a front cell, a plurality of middle cells, and an end cell formed inside and upper and lower surfaces formed of an inclined surface progressively and symmetrically reduced and inclined with respect to a tube center line toward the rear to have the front cell thicker than the end cell, stacked in multiple stages, wherein the heat-radiating fins placed at gaps among the tubes are zigzag-bent, the upper and lower surfaces of the heat-radiating fins are formed of an inclined surface progressively and symmetrically enlarged and inclined with respect to a fin center line toward the rear in order to be brazed and welded to the upper and lower surfaces among the tubes, and wind direction guiding ribs, each tilted toward the upper and lower surfaces of the tubes, are protruded from each of the heat-radiating fins to enable the wind to be blown along the upper and lower surfaces of the tubes.

According to the present invention, the tubular heat exchanger includes the zigzag-bent heat-radiating fins fitted into the gaps among the tubes, stacked in multiple stages of equidistant intervals, to be integrated with the gaps with a brazing method, wherein the upper and lower surfaces of the tubes are each formed of the inclined surface progressively and symmetrically reduced and inclined with respect to the tube center line toward the rear to have a front end thicker than a rear end. Accordingly, if the tubes, each having the front end thicker than the rear end, are stacked in the equidistant intervals, the gaps among the tubes become wider toward the rear. Also, the upper surfaces of the tubes are also more inclined downward toward the rear to enable foreign substance to be dropped downward even if the foreign substance is on the tube surfaces.

Also, the upper and lower surfaces of the heat-radiating fins placed among the tubes, formed of the inclined surfaces, are each formed of an inclined surface progressively and symmetrically enlarged and inclined with respect to the fin center line toward the rear in order to come in contact with the upper and lower surfaces of the tubes and be brazed and heat-welded to the upper and lower surfaces of the tubes.

Also, a front end of each of the heat-radiating fins is formed of an indented portion, indented toward an inner portion. The front ends of the tubes are thicker than the rear ends of the tubes, thereby making the front gaps among the tubes become relatively narrower than the rear gaps among the tubes. Accordingly, excess wind pressure is occurred at the front ends while the wind passes the gaps among the tubes. If the front ends of the heat-radiating fins are vertically stood and block entrances of the narrowed front gaps, the wind pressure becomes greater. The indented portion enables the front gaps among the tubes to be opened and functions as a guide hole, through which the wind is blown toward an inner portion, thereby preventing excess airflow resistance from occurring at the front gaps. Also, the heat-radiating area reduced by the indented portion is complemented by the heat-radiating fins formed at the rear gaps among the tubes. That is, the rear gaps among the tubes are relatively greater than the front gaps, thereby increasing the area of the heat-radiating fins arranged at the rear gaps to naturally complement the heat-radiating area reduced by the indented portion.

Also, the wind direction guiding ribs, guiding the wind toward the rear ends of the tubes, are formed at the rear portions of the heat-radiating fins to enable the wind to be blown along rear end surfaces of the tubes in order to improve the air-cooling performance at the tube surfaces. The tubes become narrower toward the rear, thereby causing the wind to be more deviated from the tube surfaces toward the rear and degrading the air-cooling performance of the surfaces. The wind direction guiding ribs, changing the air flow, is disposed at the rear portions of the heat-radiating fins to solve the problem.

BRIEF DESCRIPTION OF THE DRAWINGS

FIG. 1 is a perspective view showing the configuration of a common tubular heat exchanger;

FIG. 2 is a cross-sectional view of a conventional tube for a heat exchanger;

FIG. 3 is a cross-sectional view of a conventional oval tube for a heat exchanger;

FIG. 4 is a disassembled perspective view of tubes and heat-radiating fins according to an embodiment of the present invention;

FIG. 5 is a process view showing a process of manufacturing a heat-radiating fin according to an embodiment of the present invention;

FIG. 6 is a cross-sectional view of a tubular heat exchanger according to an embodiment of the present invention;

FIG. 7 is an exploded view of an exemplary heat-radiating fin according to an embodiment of the present invention;

FIG. 8 is a flow analysis of a tube according to an embodiment of the present invention and a flow analysis of a conventional tube; and FIG. 9 is a cross-sectional view of a tubular heat exchanger according to another embodiment of the present invention.

DETAILED DESCRIPTION OF THE PREFERRED EMBODIMENTS

FIGS. 4 to 6 illustrate a heat exchanger according to an embodiment of the present invention. Tubes 100 are continuously extruded. During the extrusion process, quadrilateral middle cells 102 are formed inside by a plurality of partition walls 101, and a front cell 103 and an end cell 104, both having a streamlined cross-section, are formed at front and rear portions. Upper surfaces 105 and lower surfaces 106 of the tubes 100 are formed of an inclined surface progressively and symmetrically reduced and inclined with respect to a tube center line TL toward the rear, and the front cell 103 is thicker than the end cell 104.

According to an embodiment of the present invention, a tube is 16 mm from a front end to a rear end. The thickness of the front cell 103 is 3 mm, and that of the end cell 104 is 1.5 mm. Also, the interval among the tubes 100 is approximately 9.8 mm with respect to the tube center line TL.

Heat-radiating fins 200 placed in the gaps among the tubes are manufactured as in FIG. 5. A rolled plate is unrolled, and an indented portion 201 is cut and formed at a front portion of the plate with respect to a virtual bending line BL. After the indented portion 201 is formed on the plate, the plate is passed between a pair of an upper roller 300 and a lower roller 301. Here, the bending line BL is vertically bent to form the zigzag heat-radiating fins 200. While the heat-radiating fins 200 are zigzag-bent, wind direction guiding ribs 202 are also bent together. The wind direction guiding ribs 202 may be manufactured with the indented portion 201 before the heat-radiating fins 200 are bent. The upper roller 300 and the lower roller 301 are manufactured in the shape of a cone. The shafts of the upper roller 300 and the lower roller 301 are not in parallel and are tilted toward each other. Accordingly, a rear portion forms a greater area than a front portion if the heat-radiating fins 200 are manufactured.

As shown in FIG. 7, the heat-radiating fins manufactured by the above-mentioned method are closely attached and brazed to the upper surfaces 105 and the lower surfaces 106 among the tubes 100 stacked in multiple stages after a filler agent is applied on the surfaces of the heat-radiating fins to integrate the tubes 100 with the heat-radiating fins 200 in order to manufacture a heat exchanger.

As in FIG. 6, the heat exchanger manufactured by the above-mentioned method includes the tubes 100 placed in such a way that the tube center lines TL are parallel to each other, and the upper surfaces 105 and the lower surfaces 106 formed of an inclined surface reduced and inclined toward the rear, thereby causing the front gaps among the tubes 100 to relatively be narrower than the rear gaps. Since the rear gaps are wide, foreign substance is immediately discharged without being accumulated on the upper surfaces 105 of the tubes 100.

Also, the indented portion 201 is formed at the front portion of the heat-radiating fins 200 to prevent the front gaps among the tubes 100 from being blocked. Accordingly, wind may easily pass through the narrowed front gaps, thereby reducing airflow resistance at the front gaps and guiding the wind not to be stagnant at the front gaps and to be blown toward the inner portion. Since a heat-radiating area w of the middle cell 102, placed at a position corresponding to the indented portion 201, is reduced, the middle cell 102 is preferably manufactured to have a relatively smaller heat-radiating area w, and the reduced heat-radiating area w is complemented by enlarging the heat-radiating area w in the front cell 103 and the end cell 104. As in FIG. 6, the front cell 103 is a portion directly coming in contact with the wind, thereby having a relatively greater heat exchange amount than other portions. Also, the area of each of the heat-radiating fins 200 corresponding to the end cell 104 is enlarged compared with other portions, thereby complementing the insufficient heat-radiating area w from the front cell 103 and the end cell 104.

Also, the wind direction guiding ribs 202 are disposed at a rear portion of each of the heat-radiating fins 200 to guide the wind to be blown along the upper surfaces 105 and the lower surfaces 106 of the tubes 100. As in FIG. 8, the tubes 100 according to an embodiment of the present invention have a weakness, wherein the wind is more deviated from the tube surfaces toward the rear compared with a conventional tube, thereby degrading the air-cooling performance at the tube surfaces. However, each of the wind direction guiding ribs 202 has a slope fighting against the wind, thereby enhancing the air-cooling performance at the tube surfaces as the wind is blown along the upper surfaces 105 and the lower surfaces 106 of the tubes 100. Also, the wind direction guiding ribs 202 are partially cut from the heat-radiating fins 200, thereby increasing the heat-radiating area.

FIG. 9 illustrates a heat exchanger according to another embodiment of the present invention which extrudes and manufactures the tubes 100 using the same method as the previous embodiment of the present invention. That is, the upper surfaces 105 and the lower surfaces 106 are formed of an inclined surface progressively reduced and inclined with respect to the tube center line TL toward the rear to have the front cell 103 thicker than the end cell 104.

However, the another embodiment of the present invention tilts the tube center line TL in a slope $\alpha$ of a predetermined angle to enable the lower surfaces 106 to maintain the state of being horizontally parallel to the wind direction when the tubes 100 are stacked in multiple stages. Here, the upper surfaces 105 become more tilted downward than the time when the tubes 100 are manufactured, and the heat-radiating fins 200 are manufactured to be in close contact with the upper surfaces 105 and the lower surfaces 106 among the tubes 100. The heat-radiating fins 200 also become tilted to be enlarged and inclined downward from a fin center line PL parallel to an upper portion and horizontal to a lower portion, wherein the front portion forms the indented portion 201 to reduce the airflow resistance at the front portion and guide the wind toward the inner portion.

The another embodiment of the present invention configured as such has a strength, wherein the heat exchange performance at the tube surfaces is not degraded due to the lower surfaces 106 of the tubes 100 being parallel to the wind direction. Also, the upper surfaces 105 become more tilted downward than in the previous embodiment of the present invention due to the slope $\alpha$, thereby enabling foreign substance to easily be discharged by being dropped downward. The wind insufficient on the upper surfaces 105 is complemented by the wind direction guiding ribs 202, thereby not degrading the air-cooling performance at the tube surfaces.

What is claimed is:

1. A tubular heat exchanger, comprising:

a top;

a plurality of tubes stacked in multiple stages to have a front gap among the tubes narrower than a rear gap among the tubes, each tube having:

a front cell formed inside;

a plurality of middle cells formed inside;

an end cell formed inside, wherein the front cell is thicker than the end cell;

an upper surface formed of an inclined surface progressively and symmetrically reduced and inclined rearwardly from a front end of said each tube to a rear end of said each tube with respect to a tube center line; and a lower surface formed of an inclined surface progressively and symmetrically reduced and inclined rearwardly from a front end of said each tube to a rear end of said each tube with respect to the tube center line, wherein the tubes are stacked in a tilted position such that the tube center line is tilted in a slope of a predetermined angle to maintain the lower surface horizontally parallel to a wind direction; and a plurality of zigzag-bent heat-radiating fins placed among the tubes, each heat-radiating fin comprising:

a horizontal upper surface, wherein the horizontal upper surface is brazed and welded to the lower surfaces of the tubes; and a lower surface formed of an inclined surface progressively enlarged and inclined rearwardly from a front end of said each heat-radiating fin to a rear end of said each heat-radiating fin with respect to a horizontal fin center line, wherein the lower surface is brazed and welded to the upper surfaces of the tubes.

2. The tubular heat exchanger as in claim 1, wherein a front portion of said each heat-radiating fin comprises an indented portion indented toward an inner portion of the front gap among the tubes to reduce airflow resistance at the front gap.

3. The tubular heat exchanger as in claim 1, wherein one of the middle cells of said each tube located at a position corresponding to the indented portion is sized smaller than that of other middle cells due to a reduced heat-radiating area.

* * * * *